US008433229B2

(12) United States Patent
Murakami et al.

(10) Patent No.: US 8,433,229 B2
(45) Date of Patent: Apr. 30, 2013

(54) FIXING DEVICE, IMAGE FORMING APPARATUS AND FIXING METHOD

(75) Inventors: Masanori Murakami, Hachioji (JP); Hiroshi Funabiki, Uenohara (JP); Jinju Okuno, Hino (JP); Koji Yamamoto, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 280 days.

(21) Appl. No.: 12/903,810

(22) Filed: Oct. 13, 2010

(65) Prior Publication Data

US 2011/0091249 A1 Apr. 21, 2011

(30) Foreign Application Priority Data

Oct. 16, 2009 (JP) ..... 2009-239073

(51) Int. Cl.
*G03G 15/20* (2006.01)

(52) U.S. Cl.
USPC ..... 399/323; 399/92; 271/309

(58) Field of Classification Search ..... 399/92, 399/323; 271/309
See application file for complete search history.

(56) References Cited

U.S. PATENT DOCUMENTS 4,168,830 A * 9/1979 Hori et al. ..... 271/176
6,104,000 A * 8/2000 Aslam et al. ..... 219/216
2007/0206981 A1* 9/2007 Amico et al. ..... 399/323
2011/0033214 A1* 2/2011 Funabiki et al. ..... 399/323
2011/0044735 A1* 2/2011 Okuno et al. ..... 399/323
2011/0097121 A1* 4/2011 Yamamoto et al. ..... 399/323
2012/0063822 A1* 3/2012 Funabiki et al. ..... 399/323
2012/0114400 A1* 5/2012 Wazumi et al. ..... 399/323

FOREIGN PATENT DOCUMENTS

JP 60-256180 12/1985
JP 61-062087 3/1986
JP 63-140571 9/1988
JP 2004-212954 7/2004
JP 2007-086132 4/2007

* cited by examiner

*Primary Examiner* — Walter L Lindsay, Jr.
*Assistant Examiner* — Benjamin Schmitt
(74) *Attorney, Agent, or Firm* — Finnegan, Henderson, Farabow, Garrett & Dunner, L.L.P.

(57) ABSTRACT

A fixing device including: a fixing member that is heated; a pressure member to form a nip portion between the pressure member and the fixing member; first blowing unit and second blowing unit both located close to an outlet of the nip portion and separate the recording medium from the fixing member by blowing air to the recording medium, a velocity of the air discharged from the first unit is higher than that of the air discharged from the second unit, whereas a volume of the air discharged from the first unit is smaller than that of the air discharged from the second unit; and the first unit starts discharging air before a leading edge of the recording medium reaches the outlet of the nip portion, whereas the second unit starts discharging air after the leading edge of the recording medium has passed through the outlet of the nip portion.

21 Claims, 11 Drawing Sheets

FIXING DEVICE, IMAGE FORMING APPARATUS AND FIXING METHOD

This application is based on Japanese Patent Application No. 2009-239073 filed on Oct. 16, 2009 in Japanese Patent Office, the entire content of which is hereby incorporated by reference.

BACKGROUND

1. Field of the Invention

The present invention relates to a fixing device for fixing a toner image on the recording medium using the nip portion formed by a fixing member and pressure member.

2. Description of Related Art

In an image forming apparatus using an electrophotographic process such as a photocopier, printer, facsimile and multi-functional peripheral having the functions of these devices, the latent image corresponding to a document is formed on a photoreceptor, and toner is applied to this latent image, whereby the image is developed. The developed toner image is transferred onto a recording sheet. After that, the toner image transferred onto the recording sheet is fixed and the sheet is ejected.

One of the fixing devices for fixing a toner image in the aforementioned manner includes a fixing device based on the heat roller fixing method, wherein the recording sheet with the toner image transferred thereto is sandwiched and transferred, using a nip portion formed between a fixing roller with a halogen heater built therein, and a pressure roller for applying pressure to the fixing roller, and, at the same time, this recording sheet is exposed to heat and pressure. Such a fixing device has been employed over an extensive range because of the simple structure.

Another example of the aforementioned fixing devices is a fixing device of the belt fixing method, wherein an endless fixing belt is applied to a heating roller with a halogen heater or the like built therein and a fixing roller, the aforementioned fixing device being provided with a pressure roller for applying pressure to the fixing roller through the fixing belt, and the recording sheet with toner image transferred thereto is sandwiched and transferred, using a nip portion formed between the fixing roller and pressure roller, while the aforementioned recording sheet is exposed to heat and pressure at the same time. Such a fixing device characterized by a smaller thermal capacity of the fixing belt reduces warm-up time and saves power.

In this case, the toner of the toner image on the recording sheet is heated in the process of passing through the nip portion. Thus, the toner acts as an adhesive; therefore, the recording sheet having passed through the nip portion sticks to the surface of the fixing roller and fixing belt and winds around the same without getting separated. This may cause a paper jam to occur. Separability is further reduced when a sheet of a smaller basis weight (thin paper), particularly when the coated paper of reduced basis weight for printing is used as a recording sheet.

In the meantime, if the fixing roller is increased to ensure a nip width of sufficient size to cope with the increasing speed of the image forming apparatus, the roller curvature at the fixing nip outlet is reduced, with the result that sheet separability is further reduced.

To facilitate separation of the recording sheet from the fixing member, various measures have been taken. For example, the surface layer of the fixing member is made of a heat-resistant resin with high release characteristics, or is coated with a mold releasing agent such as silicone oil. Alternatively, the toner is impregnated with the wax that acts as a mold releasing agent when made molten by heat. However, there have been a growing number of factors for reducing the separability, including formation of an image on the coated paper, and an increase in the toner adhesive power caused by an increasing amount of toner due to the need of overlapping the toners of a plurality of colors for forming a color image. This makes it essential to use a separation assisting device.

In one of the means for assisting separation, a separation claw coated with fluorine resin characterized by excellent release characteristics is provided on the side of rejecting the recording sheet for the nip portion, and the leading edge thereof is brought in contact with the outer surface of the fixing roller or fixing belt, whereby the recording sheet is separated from the fixing roller and others.

However, the leading edge of the separation claw is in contact with the surface of the fixing roller or others. Accordingly, the surface layer formed of the fluorine resin and others coating the fixing roller and others is scratched, and the scratch is transferred to the image. This problem tends to be serious since a glossy image is required especially in the case of a color image.

One of solutions to this problem is a technique wherein air is blown on the outside side of the nip portion to separate the recording sheet from the fixing roller and others.

One example of this technique is found in a sheet separation device wherein compressed air provided by a compressor is stored in two air boxes, and two electromagnetic valves connected to the air boxes are alternately turned on and off so as to jet compressed air and to meet the requirements of a high-speed photocopier (Unexamined Japanese Patent Application Publication No. Sho 60 (1985)-256180).

And another sheet separation device is known in which a plurality of manifolds are provided and when a first air blow can not separate the sheet, a second air blow is executed for separating the sheet (Unexamined Japanese Patent Application Publication No. Sho 61 (1986)-62087).

Another example is a fixing device wherein a separation claw (separation claw) is provided and the air fed by a fan is blown on the nip portion (Japanese Utility Model Laid-Open No. Sho 63 (1988)-140571).

Further, another known example is a separation device wherein a separation assisting plate is arranged close to the nip portion and spiral-formed compressed air is jetted out from between the fixing roller and separation assisting plate (Unexamined Japanese Patent Application Publication No. 2004-212954).

Another known example is a fixing device wherein the compressed air produced from a compressor is jetted out by two electromagnetic valves and high-pressure compressed air is jetted when the leading edge of the recording sheet has passed through the nip portion. After that, the compressed air of lower pressure is blown thereafter (Unexamined Japanese Patent Application Publication No. 2007-86132).

When air is blown so that the fixed recording sheet will not stick to the fixing roller or others, and the recording sheet is separated from the fixing roller, the effect is influenced by the area of the portion on which air is blown. If no toner image is formed close to the leading edge of the recording sheet and there is a wide area free from adhesive force, the leading edge of the recording sheet is separated by the toughness and weight of the recording sheet, and air is received by the separated area. This provides a greater separation force. However, when a toner image has been formed up to the leading edge of the recording sheet, the recording sheet is conveyed in the direction tangential to the outer periphery of the fixing roller and others. This minimizes the clearance between the leading edge of the recording sheet and the outer periphery of the fixing roller and others. For example, when the outer diameter of the fixing roller is 90 mm and the margin of the leading edge of the recording sheet is 3 mm, the clearance is only 0.1 mm. To blow air into this clearance and to lift the leading edge of the recording sheet, it is necessary to blow air at a high velocity, namely, high pressure air to the nip portion. To achieve this, it is preferred to use the high-pressure compressed air produced from a compressor.

The recording sheet having passed through the nip portion sticks to the surface of the fixing roller or fixing belt and winds around the same without being separated. This phenomenon occurs not only at the leading edge of the recording sheet but also after the leading edge. Further, even if the leading edge of the recording sheet is pulled out by the sheet ejection roller, irregular separation occurs at the wound portion. Accordingly, when air is blown on the outlet side of the nip portion to separate the recording sheet from the fixing roller and others, air must be blown on a continuous basis.

If compressed air is blown on a continuous basis in this manner, compressed air close to 0.01 $m^3/s$ will be required. A great amount of energy is required to produce compressed air. To produce the compressed air of this air volume, a large-power compressor with a capacity of 5 to 10 kW must be used. The size of the device including a compressor and air tank may reach a high level of about 1 $m^3$.

In the conventional literatures, it is difficult to find a structure that meets the related performances without allowing the size of the device to increase.

To be more specific, the Unexamined Japanese Patent Application Publication No. Sho 60 (1985)-256180 may result in producing a large-sized device including a large-power compressor, as described above.

The Unexamined Japanese Patent Application Publication No. Sho 61 (1986)-62087 may result in producing a large-sized device including a large-power compressor also, because of being provided with a plurality of airbag manifolds.

The Japanese Utility Model Laid-Open No. Sho 63 (1988)-140571 uses the air fed by a fan. In this case, the high pressure air cannot be obtained, and use of a combination with a separation claw is inevitable. Accordingly, the surface layer of the fixing roller will be scratched by the separation claw. This problem has not been solved.

In the Unexamined Japanese Patent Application Publication No. 2004-212954, after the leading edge of the recording sheet has been removed by compressed air, the recording sheet is separated by a sharp separation assisting plate. This may cause the image of the recording sheet to be scratched.

In the Unexamined Japanese Patent Application Publication No. 2007-86132, after the leading edge of the recording sheet has been removed by compressed air, the pressure of the compressed air is reduced. However, to maintain separability, a sufficient amount of air is required. To ensure this amount of air, a large-sized device equipped with a large-power compressor will have to be produced, as described above.

In view of the problems described above, it is an object of the present invention to provide a fixing device, an image forming apparatus provided with this fixing device, and a fixing method, wherein the fixing device separates the leading edge of a recording sheet by compressed air, without having to use a large-power compressor or allowing the device to be increased in size.

SUMMARY

To achieve at least one of the abovementioned objects:

1. A fixing device reflecting one aspect of the present invention comprises: a heated fixing member, a pressure member to form a nip portion between the pressure member and the fixing member, wherein the fixing member and the pressure member fix a toner image on a recording medium; a first blowing unit located close to an outlet of the nip portion which separates the recording medium from the fixing member by blowing air to the recording medium; and a second blowing unit located close to an outlet of the nip portion which separates the recording medium from the fixing member by blowing air to the recording medium, wherein a velocity of the air discharged from the first blowing unit is higher than that of the air discharged from the second blowing unit, whereas a volume of the air discharged from the first blowing unit is smaller than that of the air discharged from the second blowing unit; and the first blowing unit starts discharging air before a leading edge of the recording medium reaches the outlet of the nip portion, whereas the second blowing unit starts discharging air after the leading edge of the recording medium has passed through the outlet of the nip portion.

2. The fixing device described in Structure (1) wherein the volume of air discharged from the first blowing unit is capable of separating the recording medium from the fixing member before the leading edge of the recording medium reaches the outlet of the nip portion.

3. The fixing device described in Structure (1) wherein the volume of air discharged from the first blowing unit is capable of separating the recording medium from the fixing member when the leading edge of the recording medium has reached the outlet of the nip portion.

4. The fixing device described in Structure (1) wherein air is discharged from the first blowing unit even after air discharge by the second blowing unit has started.

5. The fixing device described in Structure (1) wherein discharge of air from the first blowing unit is suspended after the volume of air discharged from the second blowing unit has risen to the level capable of separating the recording medium from the fixing member.

6. The fixing device described in Structure (1) wherein the first blowing unit has a first valve for controlling air discharge by open-close operations, and the second blowing unit has a second valve for controlling air discharge by open-close operations.

7. The fixing device described in Structure (6) wherein the second valve starts opening before the first valve starts closing.

8. The fixing device described in Structure (7) wherein, after the first valve has started closing, the sum of the volume of air discharged from the first blowing unit and the volume of air discharged from the second blowing unit is equal to or greater than the volume of air capable of separating the recording medium from the fixing member.

9. The fixing device described in Structure (1) wherein, before the trailing edge of the recording medium is conveyed to the outlet of the nip portion, the volume of air discharged from the second blowing unit is maintained at the level that allows the recording medium to be separated from the fixing member.

10. The fixing device described in Structure (6) wherein the second valve starts closing after the trailing edge of the recording medium has passed through the outlet of the nip portion.

11. The fixing device described in Structure (1) wherein the first blowing unit discharges the high-pressure air generated by a compressor, and the second blowing unit discharges the air sent by a fan.

12. The fixing device described in Structure (11) wherein the first valve of the first blowing unit is an electromagnetic valve, and the second valve of the second blowing unit is an open/close valve that opens or closes inside a duct.

DETAILED DESCRIPTION OF THE PREFERRED EMBODIMENTS

Figure 1:
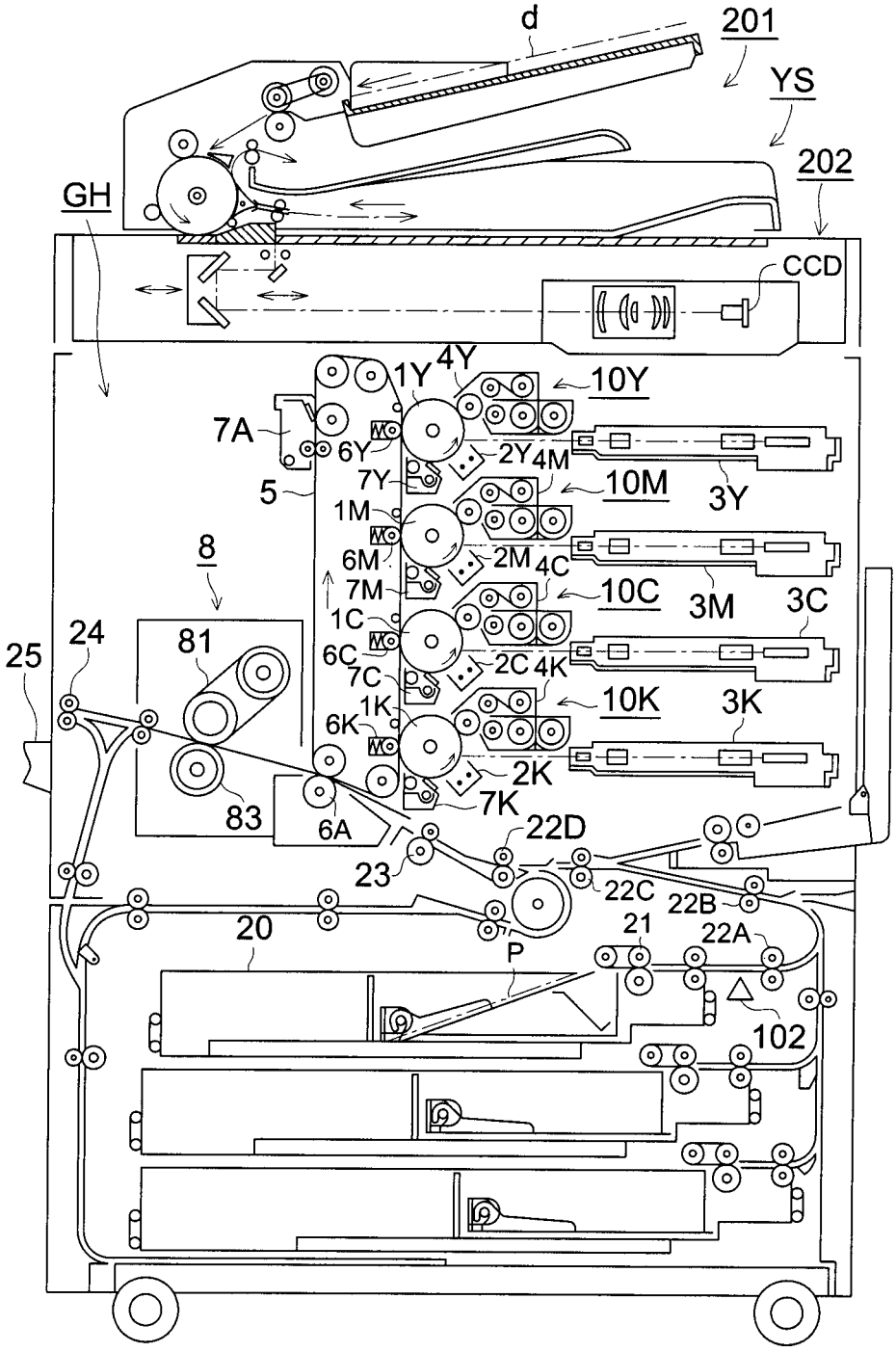
FIG. 1 is a schematic diagram representing an image reading apparatus.

The following describes the embodiments of the present invention with reference to the drawings.

In the first place, an example of the image forming apparatus using the present invention will be described with reference to FIG. 1.

This image forming apparatus includes an image forming apparatus main unit GH and an image reading device YS.

The image forming apparatus main unit GH is called the tandem color image forming apparatus, and includes a plurality of image forming sections 10Y, 10M, 10C and 10K, belt-shaped intermediate transfer belt 5, sheet feed and conveying unit and belt conveying device 8.

The top of the image forming apparatus main unit GH is provided with an image reading device YS including an automatic document feed device 201 and document image scanning exposure device 202. The document d placed on the document platen of the automatic document feed device 201 is conveyed by the conveying unit The image on one or both surfaces of the document is subjected to scanning and exposure by the optical system of the document image scanning exposure device 202, and is read into the line image sensor CCD.

The signal formed by photoelectric conversion through the line image sensor CCD is subjected to analog processing, analog-to-digital conversion, shading correction and image compression in the image processing section, and is sent to the exposure units 3Y, 3M, 3C and 3K.

The image forming sections 10Y forming a yellow (Y) image has a charging unit 2Y, exposure unit 3Y, development unit 4Y and cleaning unit 7Y arranged around the photoreceptor drum 1Y. The image forming sections 10M forming a magenta (M) image has a charging unit 2M, exposure unit 3M, development unit 4M and cleaning unit 7M arranged around the photoreceptor drum 1M. The image forming sections 10C forming a cyan (C) image has a charging unit 2C, exposure unit 3C, development unit 4C and cleaning unit 7C arranged around the photoreceptor drum 1C. The image forming sections 10K forming a black (K) image has a charging unit 2K, exposure unit 3K, development unit 4K and cleaning unit 7K arranged around the photoreceptor drum 1K. Latent image forming units are formed by a charging unit 2Y and exposure unit 3Y, a charging unit 2M and exposure unit 3M, a charging unit 2C and exposure device 3C, and a charging unit 2K and exposure device 3K.

The development units 4Y, 4M, 4C and 4K includes the two-component developer made of yellow (Y), magenta (M), cyan (C) and black (K) toners having a small particle diameter, and carriers. The toner is made of pigment or dye serving as a coloring reagent, a wax helping separation of toner from the fixing member after fixing, and a binder resin for holding them together.

The intermediate transfer belt 5 is driven by a plurality of rollers and is supported rotatably.

The fixing device 8 allows the toner image of the recording sheet (recording medium) P to be heated and pressed by the nip portion formed between the heated fixing belt 81 and pressure roller 83, whereby the toner image is fixed in position.

Thus, images of different colors formed by the image forming sections 10Y, 10M, 10C and 10K are sequentially transferred onto the rotating intermediate transfer belt 5 by the transfer units 6Y, 6M, 6C and 6K (primary transfer), and a composite color toner image is created. The recording sheet P stored in the sheet feed cassette 20 is fed by the sheet feed unit 21, and is conveyed to the transfer unit 6A through the sheet feed rollers 22A, 22B, 22C and 22D, registration roller 23 and others. Then the color image is transferred onto the recording sheet P (secondary transfer). The recording sheet P with the color image transferred thereon is heated and pressed by the fixing device 8, and the color toner image of the recording sheet P is fixed. After that, the sheet is sandwiched by the sheet ejection roller 24 and is placed on the sheet ejection tray 25 placed outside the apparatus.

In the meantime, after the color image has been transferred to the recording sheet P by the transfer unit 6A, the recording sheet P is subjected to curvature-separation from the intermediate transfer belt 5. Then the toner is removed from the intermediate transfer belt 5 by a cleaning unit 7A.

The image forming apparatus for color image formation has been described so far. However, it can be an image forming apparatus for forming a monochromatic image, and the intermediate transfer belt need not be used.

Figure 2:
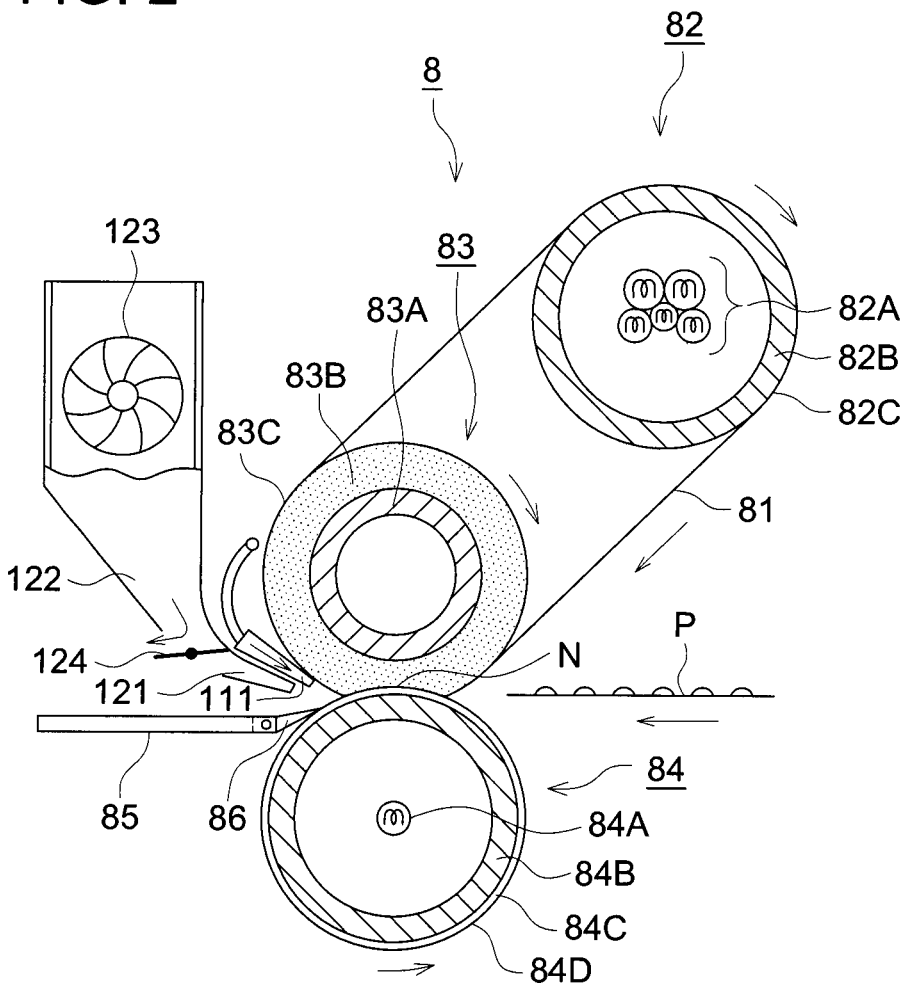
FIG. 2 is a cross sectional view of a belt fixing device wherein the second valve is placed in a closed position.

The following describes the fixing device 8 of the present invention with reference to the cross sectional view of FIG. 2.

The fixing belt 81 (fixing member) is formed in an endless structure. For example, the basic structure is made of PI (polyimide) having a thickness of 70 μm. The outer peripheral surface of the basic structure is coated with a heat resistant silicone rubber (hardness JIS-A15°) having a thickness of 200 μm, which is further covered with a tube made of heat-resistant resin PFA (perfluoroalkoxy) having a thickness of 30 μm. The outer diameter is 170 mm, for example. It is also possible to use other structures. For example, the basic structure can be a metal produced by nickel electroforming. A fluorine rubber can be used as an elastic layer. The surface mold releasing layer can be formed of a layer coated with fluorine resin including the PFA or PTFE (polytetrafluoroethylene).

The heating roller 82 incorporates a halogen heater 82A as a heating unit for heating the fixing belt 81. For example, the outer peripheral surface of the cylindrical core metal 82B having a thickness of 4 mm formed of aluminum and others is covered with the resin layer 82*c* coated with PTFE having a thickness of 30 μm. The outer diameter is 90 mm, for example. To conform to various sheet widths, the halogen heaters 82A consist of two 1200-watt heaters, two 750-watt heaters and one 500-watt heater, for example, and are arranged to ensure different heat generation distribution in the axial direction to conform to various widths of the recording sheets.

The fixing roller 83 includes a solid core metal 83A, which is as an elastic layer 83B formed of a metal such as iron. This core metal is coated with a heat resistant silicone rubber (hardness JIS-A10°) having a thickness of 17 mm. This is further covered with a resin layer 83C coated with a low-friction and heat-resistant resin having a thickness of 30 μm. The outer diameter is 90 mm, for example.

The pressure roller 84 (pressure member) incorporates a halogen heater 84A to reduce the time for temperature rise immediately after the power is turned on. The outer peripheral surface of the cylindrical core metal 84B having a thickness of 4 mm formed of aluminum and others is covered with a heat resistant silicone rubber (hardness JIS-A10°) having a thickness of 2 mm as an elastic layer 84C. This is further coated with a resin layer 84D of a PFA tube having a thickness of 30 μm. The outer diameter is 90 mm, and the halogen heater 84A has a 700-watt power supply, for example.

The pressure roller 84 uses a biasing unit (not illustrated) to press the fixing roller 83 through the fixing belt 81.

In the aforementioned structure, when the pressure roller 84 is turned in the counterclockwise direction by a drive unit (not illustrated), the fixing belt 81 and heating roller 82 are turned in the clockwise direction. The fixing roller 83 is also turned in the clockwise direction. The fixing roller 83 can also be driven. Further, the fixing belt 81 is heated by the halogen heater 82A through the heating roller 82 in contact and the pressure roller 84 is also heated by the halogen heater 84A. The pressure roller 84 is biased in the direction of the fixing roller 83 by the biasing unit (not illustrated). Accordingly, the recording medium P having been fed is heated and pressed at the nip portion N formed between the fixing belt 81 and pressure roller 84 driven by the fixing roller 83, whereby a toner image is fixed on the recording medium P.

The following describes the fixing conditions.

| | |
|---|---|
| Fixing load: | 2000 N |
| Fixing belt tension: | 250 N |
| Fixing belt control temperature: | 160 through 200° C. |
| Pressure roller control temperature: | 80 through 120° C. |
| Recording sheet conveying speed: | 500 mm/s |

Any desired heating unit can be used as a heating unit for heating the fixing belt 81. For example, it is possible to employ an inductive heating element using an exciting coil. Further, the heating unit installation site is not restricted to the position inside the heating roller 82.

It is also possible to provide a tension roller to provide the fixing belt 81 with tension, or a belt offset control roller to control meandering of the belt.

In the aforementioned fixing device 8, the fixed recording medium P is ejected from the nip portion N. If the fixed recording medium P sticks to the fixing belt 81 and winds around this belt, a paper jam may occur. To avoid this, it is essential to separate the recording medium P completely from the fixing belt 81.

In this fixing device 8, a first air nozzle 111 (first blowing unit) and second air nozzle 121 (second blowing unit) are provided as separation units close to the outlet of the nip portion N. The first air nozzle 111 is used to jetting compressed air produced by the compression of a compressor. Air is blown for a short time on the leading edge of the recording sheet P immediately after having passed through the nip portion N so that the leading edge of the recording sheet P is separated from the fixing belt 81. In the meantime, the second air nozzle 121 continuously jets air provided by the fan or blower through a duct 122. This air is blown on the recording sheet P whose leading edge has been separated, to ensure that the separated recording sheet P will not stick to the fixing belt 81.

By way of an example, the air of the first air nozzle 111 is blown to the outer peripheral surface of the fixing belt 81 located at 25 mm from the outlet of the nip portion N, and the air of the second air nozzle 121 is blown to the outer peripheral surface of the fixing belt 81 located at 10 mm from the outlet of the nip portion N.

Figure 3:
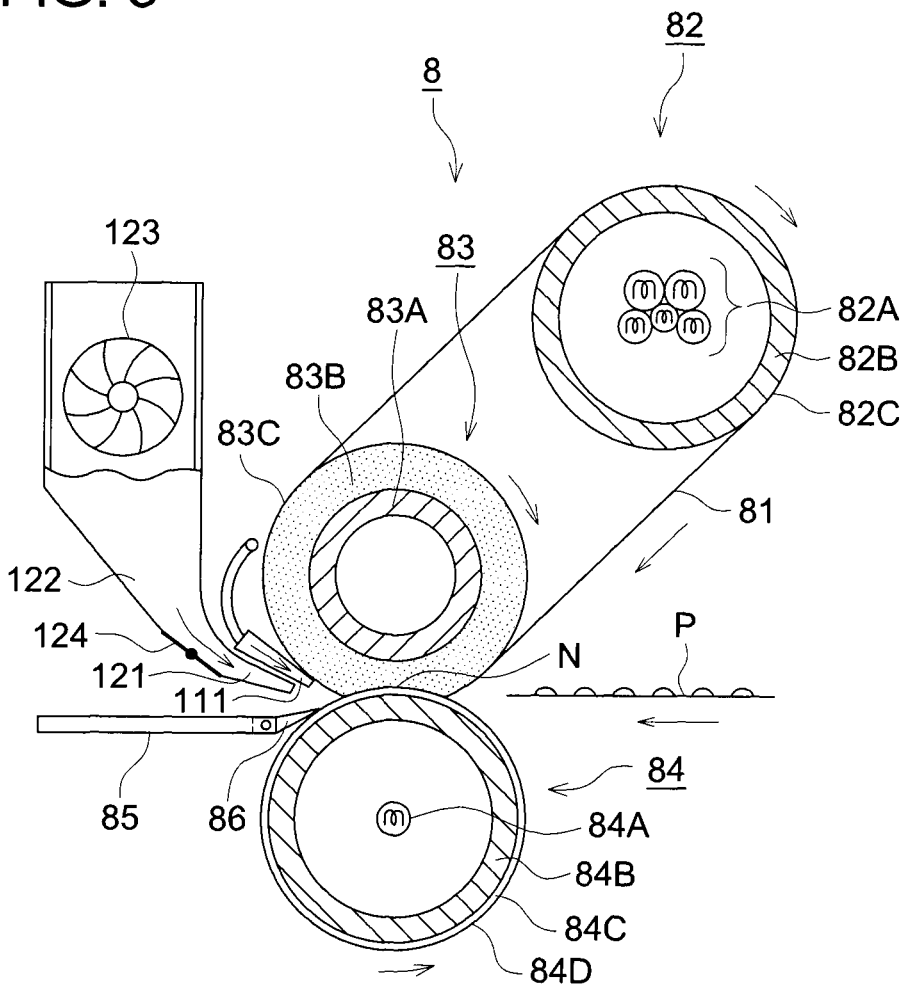
FIG. 3 is a cross sectional view of a belt fixing device wherein the second valve is placed in an open position.

As will be described later in detail, the duct 122 is provided with a second valve 124 (open-close valve) for allowing air of the fan 123 to be discharged from the second air nozzle 121 or for suspending the air. FIG. 2 shows that the second valve 124 is placed in a closed position, while FIG. 3 shows that the second valve is placed in an open position.

The air from the first air nozzle 111 must be discharged at a higher velocity since this air is used to separate the leading edge of the recording sheet P from the fixing belt 81. However, the amount of this air can be kept at a smaller level because the air is discharged only for a short period of time. In the meantime, the air from the second air nozzle 121 is discharged after the leading edge of the recording sheet P has been separated, and therefore, the velocity thereof can be kept lower than that of the first air nozzle 111. However, a greater volume of this air must be discharged than that of the first air nozzle 111, because this air is discharged continuously until the entire recording sheet P passes the nip portion N. It should be noted that the volume of air from the first air nozzle 111 may be about one tenth that of the air from the second air nozzle 121. As described above, the configuration of the first air nozzle 111 is complementary to that of the second air nozzle 121. This arrangement ensures that the dimensions and power consumption are reduced to about one tenth as compared to the arrangement without a second air nozzle 121 wherein only compressed air is discharged from the first air nozzle 111. Hence this arrangement contributes to formation of a more compact and lightweight structure characterized by substantial power saving.

As described above, the recording sheet P separated from the fixing belt 81 is guided and conveyed by the sheet ejection guide plate 85. Since the separation claw 86 formed of heat resistant resin is in contact with the pressure roller 84, the recording sheet P does not wind around the pressure roller 84, even if the recording sheet P is pressed downward by the air fed from the first air nozzle 111 or the second air nozzle 121. In the separation claw 86, the leading edge, for example, is coated with about 10 mm of fluorine resin. This ensures excellent lubricity. Further, it is in contact with the pressure roller 84 at a low pressure of about 1 mN. This arrangement prevents the pressure roller 84 from being scratched. In addition, even if a toner image is located closer to the pressure roller 84 in the duplex copying mode, the toner image is not molten because the temperature of the pressure roller 84 is low. Further, the image is not damaged by the separation claw 86.

To maintain the low temperature of the pressure roller 84, the space interval between the transfer unit 6A and fixing device 8 is set at a level greater than the maximum length of the recording sheet P. At the same time, this space reduces the distance between sheets. This arrangement reduces heat transfer from the fixing belt 81 to the pressure roller 84. Further, the inner periphery and outer periphery of the pressure roller 84 can be cooled by a fan.

Further, a separation claw used in the conventional fixing device can be used as the separation claw 86.

Figure 4:
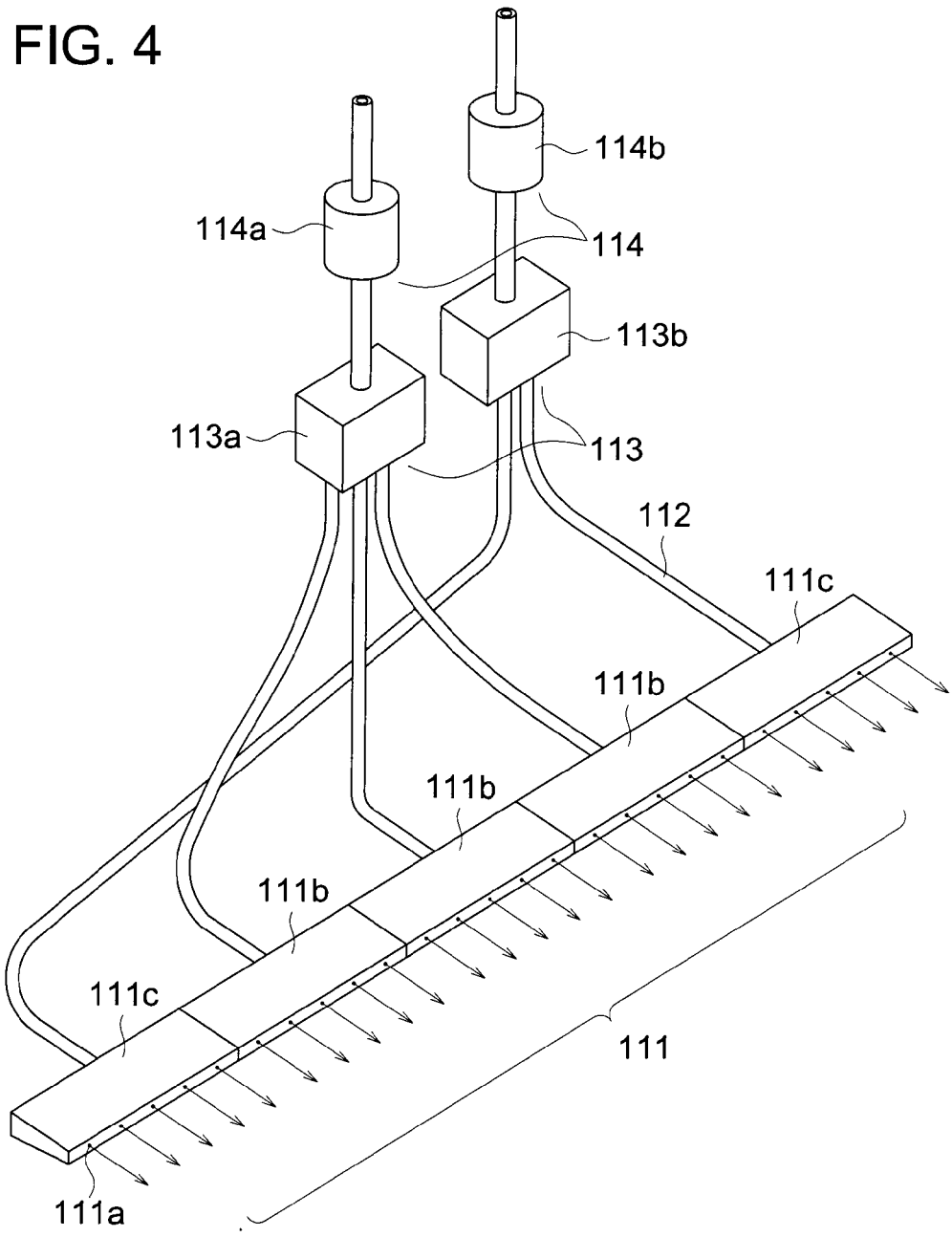
FIG. 4 is a perspective view representing a first air nozzle and electromagnetic valve.
Figure 5:
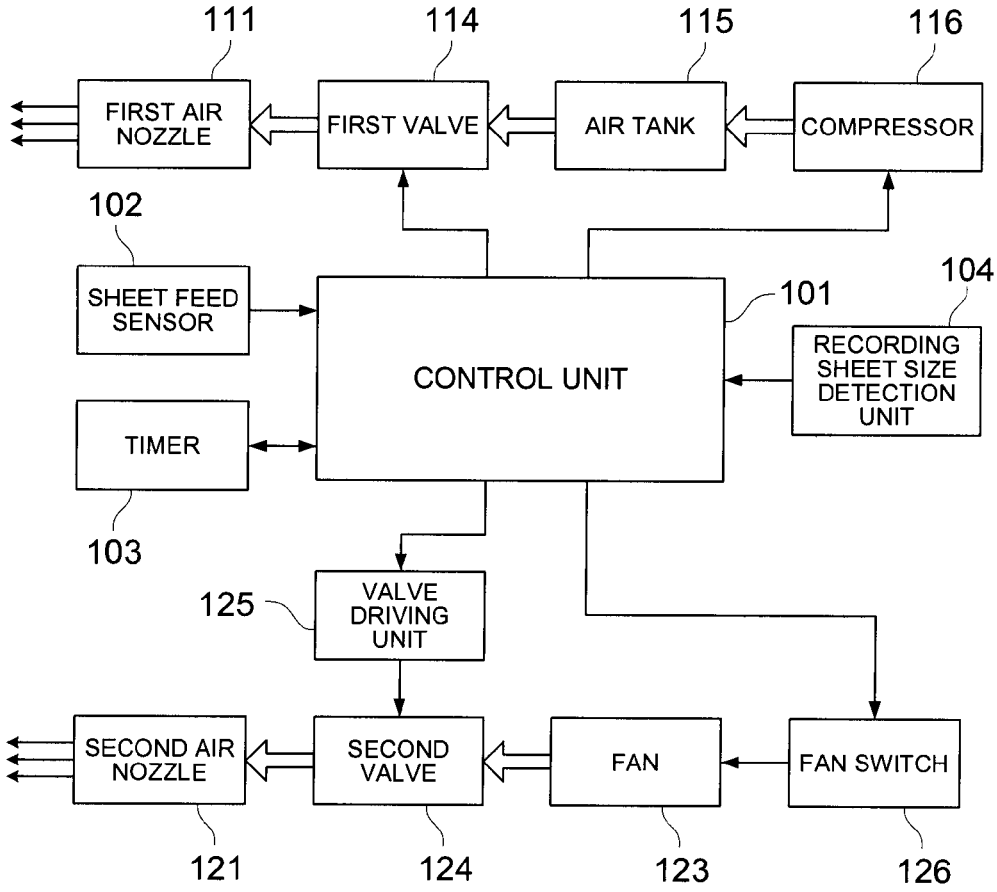
FIG. 5 is a block diagram representing the control of a compressor and fan.

The following describes the first air nozzle 111 and the related configuration with reference to FIGS. 4 and 5. FIG. 4 is a perspective view representing a first air nozzle 111 and first valve. FIG. 5 is a block diagram representing the control of a compressor and others.

In FIG. 4, five first air nozzles 111 are arranged across the recording sheet P. Each of the first air nozzles 111 is provided with thirteen nozzle holes 111*a* having a diameter of 1 min at a pitch of 5 mm. To put it another way, the total number of nozzle holes 111*a* for five first air nozzle 111 is 65.

Each of the five first air nozzles 111 is connected to two piping sections 113 using five pipes 112. Two piping sections 113 communicate with two first valves 114 as electromagnetic valves. The shape from the first valves 114 forward is not illustrated. These valves are connected and merged to the air tank 115 of FIG. 5, and the air tank 115 is linked to a compressor 116.

The first valve 114 is designed in a direct acting structure and is characterized by a capacity of 0.002 $m^3$/s (100 kPa) and response speed of 20 ms.

The air tank 115 has a capacity of 0.05 $m^3$.

The compressor 116 is designed in a reciprocal oil-free structure characterized by a power of 0.75 kW, a static pressure of 0.8 MPa, and air volume of 0.00125 $m^3$/s.

In an image forming apparatus of FIG. 1 provided with the aforementioned configuration, the sheet feed sensor 102 detects that the recording sheet P accommodated in the sheet feed cassette 20 has been fed by the sheet feed unit 21. Since the time from the detection by the sheet feed sensor 102 to the arrival of the leading edge of the conveyed recording sheet P to the outlet of the nip portion N is prescribed and is therefore known in advance, the control unit 101 including a CPU sends an on-signal to the first valve 114 about 15 ms prior to the arrival thereof using the timer 103, and sends the off-signal about 50 ms thereafter. The air tank 115 in advance contains the air compressed by the compressor 116. Thus, compressed air is discharged from the first air nozzle 111 by the opening of the first valve 114 as an electromagnetic valve, and is blown to the leading edge of the recording sheet P immediately after the recording sheet has passed through the nip portion N.

In this case, the compressed air of about 0.8 MPa stored in the air tank 115 by the compressor 116 is depressurized by the regulator (not illustrated) arranged between the air tank 115 and first air nozzle 111, and is supplied to the first air nozzle 111. For example, jetting pressure from the first air nozzle 111 is 0.1 through 0.2 MPa, the jetted air velocity is 100 through 160 m/s, and the jetted air volume is in the range from 0.005 through 0.008 $m^3$/s.

The first valve 114 is fully opened about 20 ms after the ON-signal has been inputted. The maximum air volume is reached when the recording sheet P has been fed about 10 mm from the nip portion. The maximum volume of the compressed air jetted from the first air nozzle 111 is 2 through 3 times the air volume required to separate the recording sheet P. Accordingly, the recording sheet P starts separation before the jetted volume of compressed air reaches the maximum level, namely, before the amount of feed from the nip portion N reaches 10 mm. After that, when the OFF-signal is inputted to the first valve 114, there is a gradual decrease in the volume of the compressed air jetted from the first air nozzle 111. Air jetting continues until the leading edge of the recording sheet P reaches the point 25 through 30 mm from the nip portion N. The jetted air volume in this case is sufficient to separate the recording sheet P even if there is a toner image with the maximum amount of adherence.

In Fig., three first air nozzles 111*b* arranged inside are connected to the first valve 114*a* through the piping section 113*a*. Two first air nozzles 111*c* arranged outside are connected to the first valve 114*b* through the piping section 113*b*. Further, the width of the three first air nozzles 111*b* corresponds to the short side of an A4-sized sheet, for example. The width of the five first air nozzles 111*b* and 111*c* corresponds to the long side of an A4-sized sheet, for example. Based on the input to the operation panel arranged on the upper portion of the image reading device, the recording sheet detection unit 104 detects the size of the recording sheet wherein an image is to be formed. This information is sent to the control unit 101.

When an A4-sized recording sheet is fed in the landscape configuration, the control unit 101 allows the ON-signal to be sent to both the first valve 114*a* and first valve 114*b*. However, when the A4-sized recording sheet is fed in the portrait direction, the control unit 101 allows the ON-signal to be sent only to the first valve 114*a*, not to the first valve 114*b*. This arrangement reduces the waste of compressed air and minimizes the power consumption of the compressor 116.

In this case, in the halogen heater incorporated in the heating roller, power is sent only to the area corresponding to the area wherein sheets pass, so that power is saved.

As described above, compressed air is jetted from the first air nozzle 111, the leading edge of the recording sheet P having passed through the nip portion N is separated from the fixing belt 81. After that, jetting of the compressed air is suspended. Instead, air sent by a fan from the second air nozzle 121 is blown on the recording medium P on a continuous basis to ensure that recording sheet P will not stick to the fixing belt 81.

That is to say, when a separation of the recording medium P is executed to some extent and the leading edge of the recording medium P separates from the fixing belt 81 by more than 0.2 mm, air flow of large volume and blown to wide area is preferable to compare with an air flow discharged from the first air nozzle that is compressed and blown to a narrow area with high pressure for the purpose of acting a separation force on the whole area where the recording medium P separated. Then, stop the discharge from the first air nozzle 111 and blow air that has been sent by the fan from the second air nozzle 121 to the leading edge of the recording medium P that has separated from the fixing belt 81. Accordingly, a force is applied to the recording medium P resisting to the adhesive power of the toner, without blowing from the first air nozzle 111 and the recording medium P is surely separated from the fixing roller 83.

Figure 6:
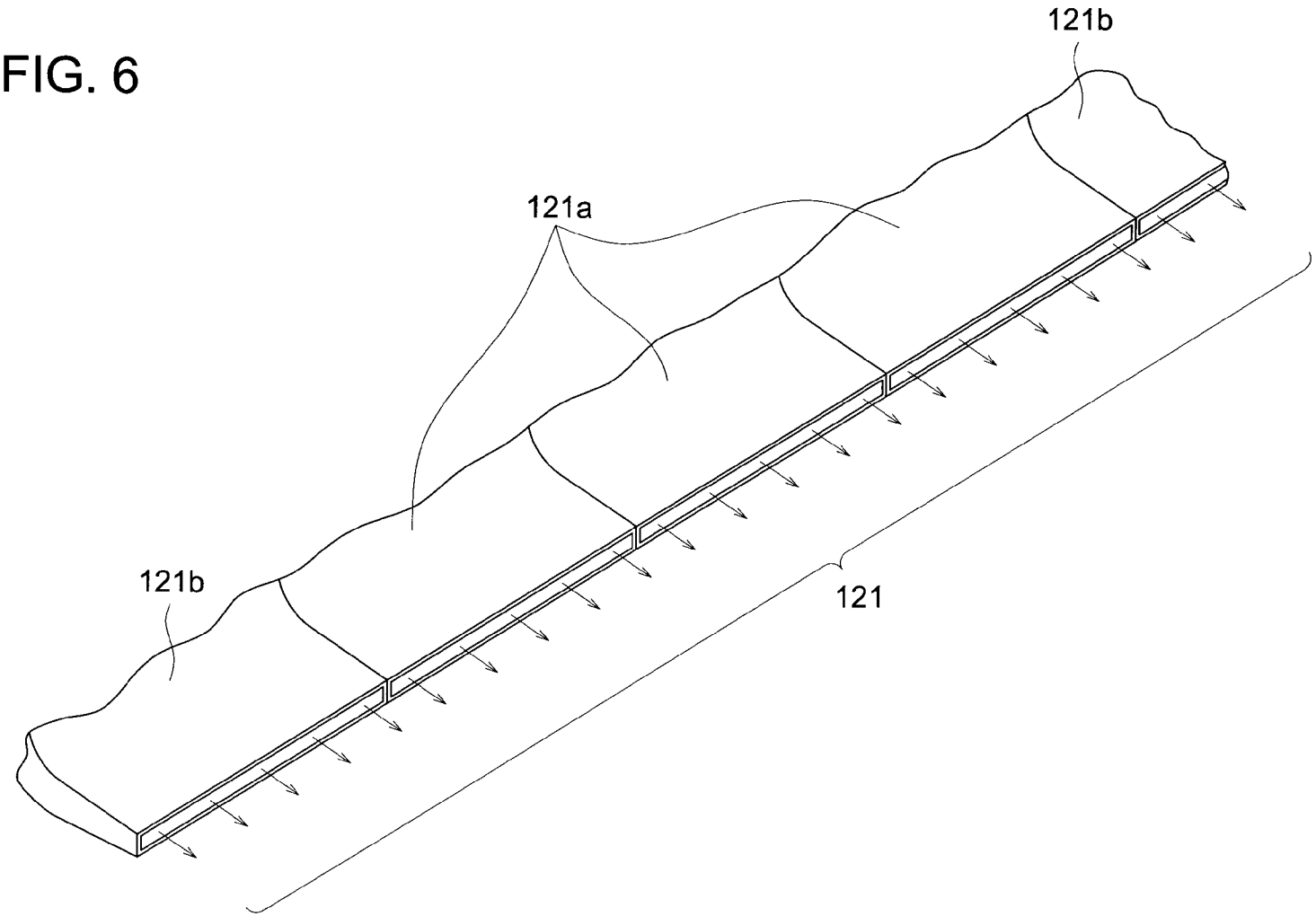
FIG. 6 is a perspective view representing a second air nozzle.

Referring to FIGS. 2, 3, 5 and 6, the following describes the second air nozzle 121 and the configuration related thereto. FIG. 6 is a perspective view showing the second air nozzle 121.

In FIG. 6, five second air nozzles 121 are arranged across the recording sheet P. The open dimensions of the second air nozzle 121 are designed in such a way as to be 65 mm across the recording sheet P and 3 mm along the thickness of the recording sheet P.

The five second air nozzles 121 are connected with fans 123 by the duct 122 of FIG. 2 and FIG. 3.

Thus, five fans 123 each having an axial flow of 70 mm are provided. The power is 12 W with a static pressure of 500 Pa.

In the image forming apparatus of FIG. 1 having the aforementioned structure, when the sheet feed sensor 102 has detected that the recording sheet P stored in the sheet feed cassette 20 is fed by the sheet feed unit 21, the control unit 101 supplies power to the fan switch 126. This procedure allows each of the fans 123 to start rotation. As shown in FIG. 2, the second valve 124 keeps the second air nozzle 121 closed. Air is blown outwardly of the fixing device 8, without being sent to the fixing roller 81, as shown by the arrow mark of FIG. 2. After that, when the leading edge of the recording sheet P having been conveyed has passed through the outlet of the nip portion N, the control unit 101 operates the valve driving unit 125 to open the second valve 124. This procedure allows air to be discharged from the second air nozzle 121, for example, at 20 m/s, so that air is blown to the recording sheet P and the recording sheet P is separated from the fixing belt 81. After the trailing edge of the recording sheet P has passed through the outlet of the nip portion N, the control unit 101 turns off the fan switch 126, and actuates the valve driving unit 12 so that the second valve 124 is closed.

The second valve 124 is made of a resin having a length of 30 mm and a thickness of 2 mm, for example, and is opened or closed by rotating 120 degrees about the spindle. The second valve 124 is driven by the valve driving unit 125. The valve driving unit 125 is made of a stepping motor and gear train. For example, the stepping motor is rotated at 300 rpm, and the second valve 124 is driven at a speed increasing ratio of 2.5 times, whereby the second valve 124 is opened or closed in about 38 ms. The valve driving unit 125 can be made of a solenoid or link mechanism.

The air pressure discharged from the second air nozzle 121 is 400 Pa. The air velocity is from 20 to 30 m/s and the air volume is from 0.025 to 0.04 $m^3/s$.

The fan 123 is not restricted to the axial flow fan. A sirocco fan, cross flow fan, or blower can be used if the air volume thereof is capable of continuously separating the recording sheet P with the leading edge separated from the fixing belt 81. The shape of the duct 122 is determined by the type of fan 123.

In FIG. 6, five second air nozzles 121 are arranged across the recording sheet P. Similarly to the case of the first air nozzle 111, the width of the second air nozzles 121*a* arranged inside corresponds to the dimension of A4-sized paper (210×298 mm) on the short side. The widths of three second air nozzles 121*a* and two second air nozzles 121*b* arranged outside correspond to the dimension of A4-sized paper on the long side, for example. Three second air nozzles 121*a* communicate with three fans 123, respectively. Two second air nozzles 121*b* communicate with two fans 123, respectively. When an A4-sized recording sheet is fed in landscape configuration, the control unit 101 turns on both the fan switch 124 corresponding to the second air nozzle 211*a* and the fan switch 124 corresponding to the second air nozzle 211*b* placed outside. However, when the A4-sized recording sheet is conveyed in portrait configuration, the control unit 101 turns on only the fan switch 124 corresponding to the second air nozzle 211*a*. This arrangement minimizes the useless rotation of the fan 123 and cooling of the fixing member by the air for separation, whereby the power consumption of the fan 123 and halogen heater 82A is reduced.

The air volume and related description in the present application refers to the operation of separating a recording sheet having the width corresponding to that of an A4-sized sheet on the long side. When the width of discharge is to be changed in response to the width of the recording sheet, the volume of air is also changed accordingly.

As described above, in an image forming apparatus equipped with a fixing device 8 including a first air nozzle 111 and second air nozzle 121, the air discharged from the first air nozzle 111 is blown to the leading edge of the recording sheet P having passed through outlet of the nip portion N so that the recording sheet P is separated from the fixing belt 81. In this case, it has been clarified in a test that, if the air from the second air nozzle 121 is also blown to the leading edge of the recording sheet P simultaneously, air from the second air nozzle 121 provides resistance to the air coming from the first air nozzle 111. This may deteriorate the performance of separating the leading edge of the recording sheet P.

Table 1 shows the results of this test

TABLE 1

| First air nozzle | Second air nozzle | Separation performance |
|---|---|---|
| 0.05 MPa | Provided | C |
| 0.04 MPa | | D |
| 0.03 MPa | | D |
| 0.05 MPa | Not provided | A |
| 0.04 MPa | | B |
| 0.03 MPa | | B |

This test is for the numerical value of the first air nozzle 111. "Provided" of the second air nozzle 121 assumes that air is discharged at a velocity of 23 m/s, and "Not provided" assumes that no air is discharged at all.

In the symbols representing the performance of separation, A indicates excellent performance, B indicates good performance, C indicates the performance wherein uneven glossiness is observed although separation is possible, and D indicates the very poor performance wherein a paper jam occurs without paper being separated.

Figure 7:
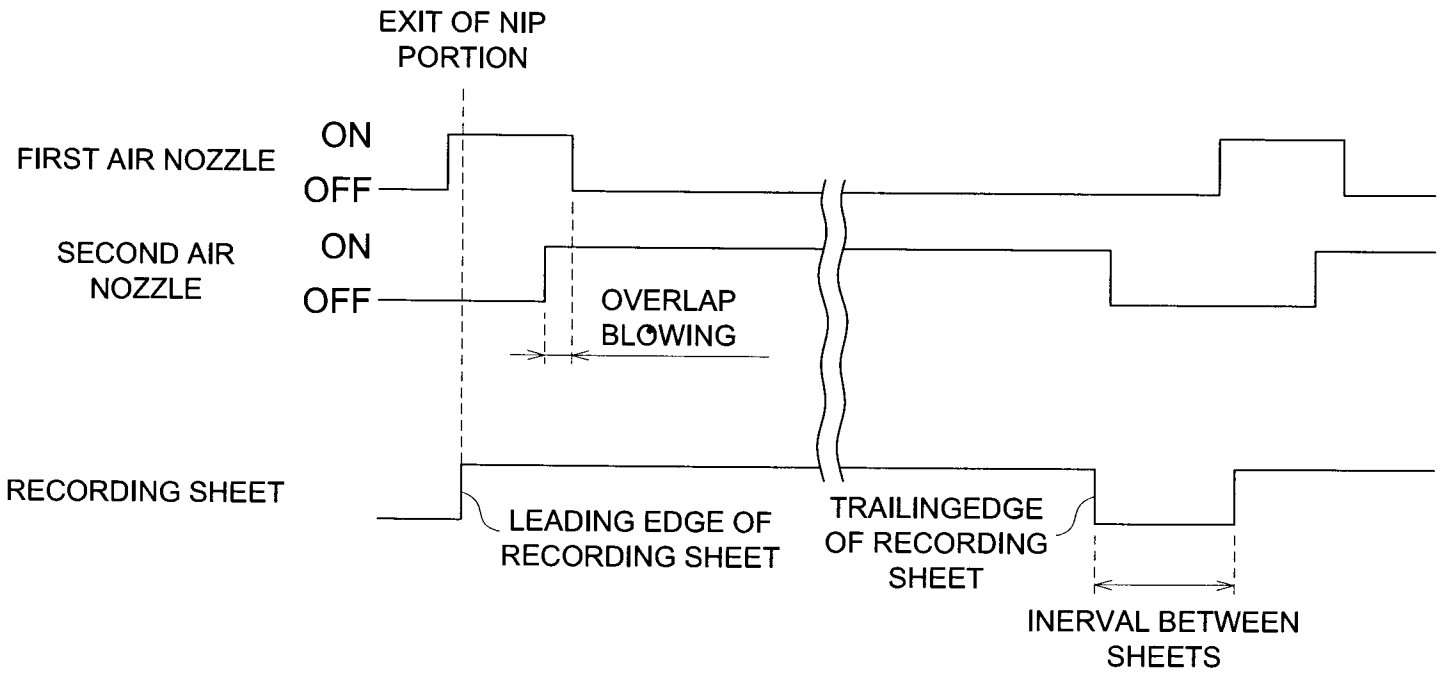
FIG. 7 is a timing chart representing discharge of air from the first and second air nozzles.

To prevent deterioration of the performance in separating the leading edge of a recording sheet P, it is necessary to properly set the time intervals for discharging air from the first air nozzle 111 and the second air nozzle 121. The configuration for appropriate setting of time intervals will be described with reference to the timing chart of FIG. 7. By way of an example, an A4-sized recording sheet P is supplied at 100 ppm.

Prior to image formation, the air compressed by the compressor 116 is stored in the air tank 115. About 15 ms before the leading edge of the recording sheet P having been conveyed reaches the outlet of the nip portion N, the control unit 101 starts opening of the first valve 114 as an electromagnetic valve, so that air is discharged from the first air nozzle 111. Since the first valve 114 is fully opened in about 20 ms, the flow rate reaches the maximum level when the leading edge of the recording sheet P has protruded about 10 mm from the outlet of the nip portion N. Air is preferably discharged at a pressure two to three times the pressure required for separation. This arrangement ensures that separation starts before the air from the first air nozzle 111 reaches the maximum flow rate, to put it another way, before the leading edge of the recording sheet P reaches a point 10 mm from the outlet of the nip portion N.

For the second air nozzle 121, as described above, discharge of air from the fan 123 is started before the leading edge of the recording sheet P reaches the outlet of the nip portion N. Since the second valve 124 is closed, air is not sent to the recording sheet P. This arrangement ensures that air from the first air nozzle 111 effectively reaches the leading edge of the recording sheet P, without being affected by the second air nozzle 121, with the result that effective sheet separation is achieved.

In this connection, it has been verified in the test that, when the leading edge of the recording sheet P has protruded 5 to 10 mm from the outlet of the nip portion N, the sheet can be separated on a continuous basis by the air sent from the fan 123 at about 20 m/s, even in the case of a thin coated sheet for printing, wherein this sheet has a base weight of about 80 $g/m^2$ and carries a solid image with the maximum amount of deposition.

Thus, 50 ms after the start of opening of the first valve 114, the control unit 101 starts closing of the first valve 114. In the meantime, prior to starting the closing of this first valve 114, the control unit 101 uses the valve driving unit 125 to start opening of the second valve 124.

In this case, since the leading edge of the recording sheet P is already separated by 10 mm or more, the air protruding from the second air nozzle 121 is blown to the leading edge of the recording sheet P having been separated. Thus, even without air being blown from the first air nozzle 111, force is applied to separate the recording sheet P against the adhesive strength of toner, without the recording sheet P sticking to the fixing belt 81. According to the test, if the recording sheet P is separated after the leading edge of the recording sheet P has wound itself by 10 mm or more, an image irregularity is produced apparently due to a change in the state of separation with an increase in the amount of winding, with the result that image quality is deteriorated. As described above, image irregularity can be suppressed if separation is started before this amount of winding is reached.

As described above, when the first valve 114 is closed and the second valve 124 is opened, there will be an overlap between the first valve 114 closing process and the second valve 124 opening process. The following describes the control under this condition.

In the test, when only the first air nozzle 111 is used, an air velocity of 160 m/s or more is required for the separation of the recording sheet P. When only the second air nozzle 121 is used, an air velocity of 20 m/s or more is required. It has been verified by calculation that the air volume per 10 mm in the axial direction is $40\times10^{-5}$ $m^3/s$ in both cases. The value required for separation varies according to the dimensions of the fixing device, mold releasing performance of the fixing belt and others, and deformation of the fixing roller on the nip portion.

Figure 8:
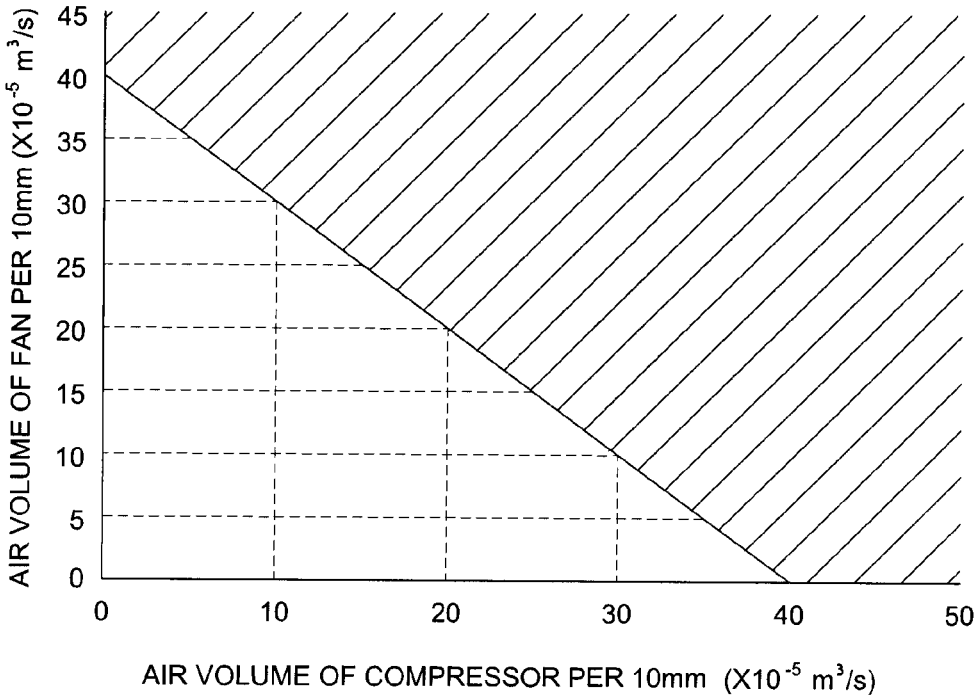
FIG. 8 is a chart showing the overall volume of air from the first and second air nozzles.

When the total required air volume of the first air nozzle 111 and the second air nozzle 121 is $40\times10^{-5}$ $m^3/s$ or more, the hatched area in the chart of FIG. 8 indicates the total air volume required for separation.

The total air volume of $40\times10^{-5}$ $m^3/s$ must be maintained at all times. This applies to the cases wherein the first valve 114 is closed. This requires appropriate setting of the time intervals of closing the first valve 114 and opening the second valve 124.

Figure 9A:
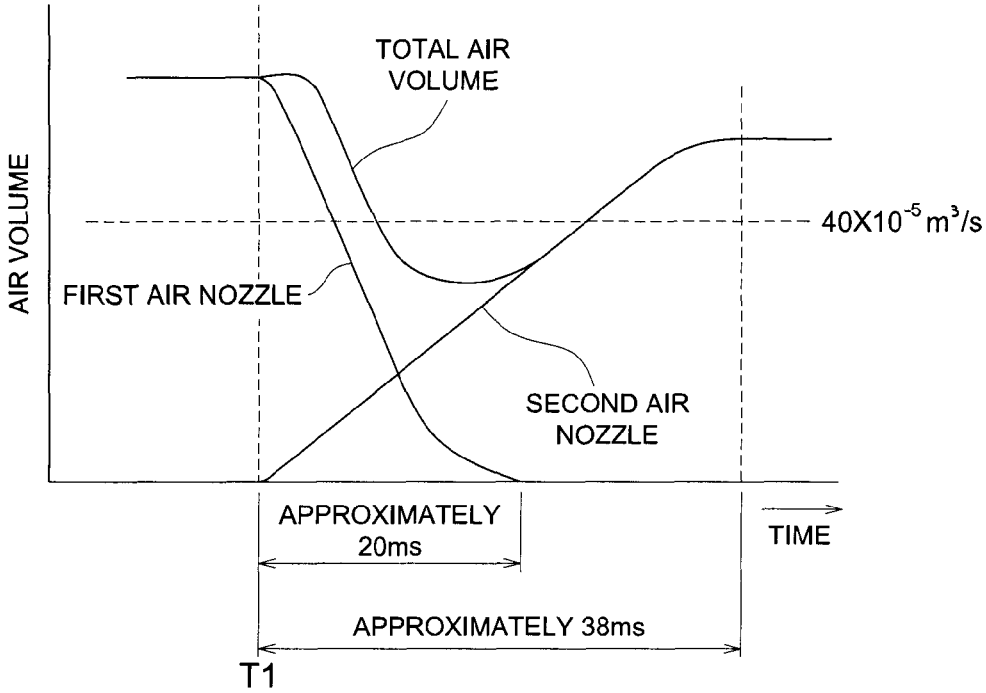
FIG. 9*a* is a timing chart showing closing of the first valve.

These time intervals will be explained with reference to the timing chart of FIG. 9. FIG. 9*a* is a timing chart showing that closing of the first valve 114 of the first air nozzle 111 at time point T1 and opening of the second valve 124 of the second air nozzle 121 are started simultaneously. The first valve 114 closes quickly in about 20 ms, while the second valve 124 opens slowly in about 38 ms. Thus, an increase in the discharge rate of air from the second air nozzle 121 cannot catch up with a decrease in the discharge rate of air from the first air nozzle 111. This will give rise to the time point wherein the total air volume fails to reach $40\times10^{-5}$ $m^3/s$ required for separation.

Figure 9B:
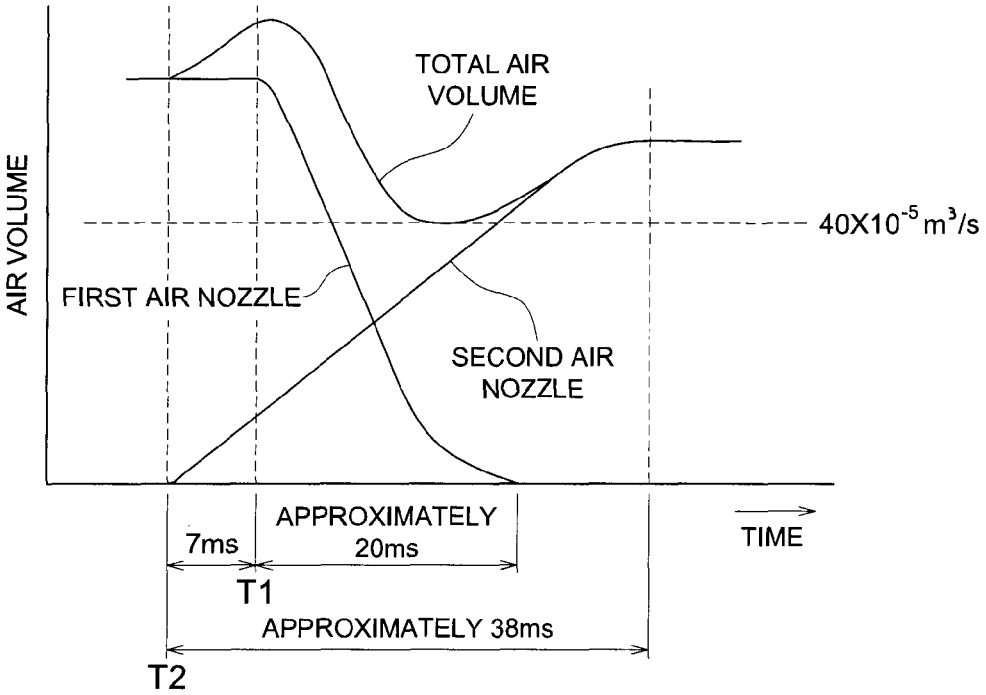
FIG. 9*b* is a timing chart showing opening of the second valve.

The solution to this problem is found in the timing chart of FIG. 9*b*. The total air volume reaches $40\times10^{-5}$ $m^3/s$ required for separation, if opening of the second valve 124 starts at time point T2 earlier than the time point T1 when the closing of the first valve 114 of the first air nozzle 111 starts. In this case, the time point T2 comes about 7 ms earlier than the time point T1. The total air volume is $40\times10^{-5}$ $m^3/s$ without safety allowance. Thus, it is preferred that the time point T2 should be set at a level of; for example, about 10 ms earlier than time point T1, thereby ensuring that the total air volume will be $40\times10^{-5}$ $m^3/s$ or more.

After the discharge rate of air from the second air nozzle 121 has increased to the level required for separation, discharge of air from the first air nozzle 111 is not necessary. Thus, control is provided in such a way that the first valve 114 is closed at this point.

After the first valve 114 has been closed completely, the second valve 124 is kept open. The volume of air required for separation is maintained only by the air discharged from the second air nozzle 121 so as to continue the operations of separating the recording sheets P. If the trailing edge of the recording sheet P has passed through the outlet of the nip portion N, the control unit 101 allows the valve control unit 125 to start closing the second valve 124.

The fixing device and image forming apparatus of the present embodiment eliminates the need of using a high power compressor and the possibility of increasing the size of the apparatus, although a recording medium is separated from the fixing member by compressed air. Further, effective blowing of air to the fixing member and positive separation of the recording medium from the fixing member are ensured by appropriate setting of the time interval of discharging air from the first blowing unit and the time interval of discharging air from the second blowing unit close to the nip portion.

The aforementioned configuration represents only one embodiment, without the present invention restricted thereto.

For example, in FIG. 2 and FIG. 3, the first air nozzle 111 is placed on the side of the fixing roller 83, and the second air nozzle 121 is arranged on the side of the sheet ejection guide plate 85. Conversely, the first air nozzle 111 can be placed on the side of the sheet ejection guide plate 85, and the second air nozzle 121 can be installed on the side of the fixing roller 83. It should be noted that, when the second air nozzle 121 is mounted on the side of the sheet ejection guide plate 85, the spindle of the second valve 124 should also be placed on the side of the sheet ejection guide plate 85. However, when the second air nozzle 121 is placed on the side of the fixing roller 83, the spindle of the second valve 124 should preferably be placed on the side of the fixing roller 83 as well.

There is no particular restriction to the position of the second valve 124 arranged in the duct 122. For example, the second valve 124 can be arranged close to the outlet of the second air nozzle 121.

Figure 10:
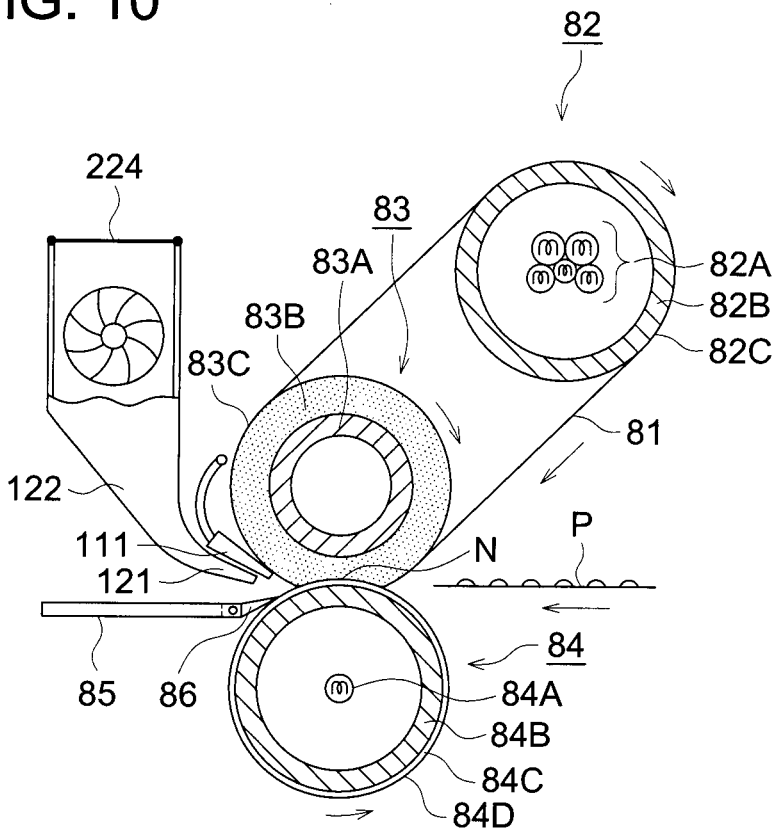
FIG. 10 is a cross sectional view of a belt fixing device wherein a second valve is arranged close to the suction port and is placed in the closed position.
Figure 11:
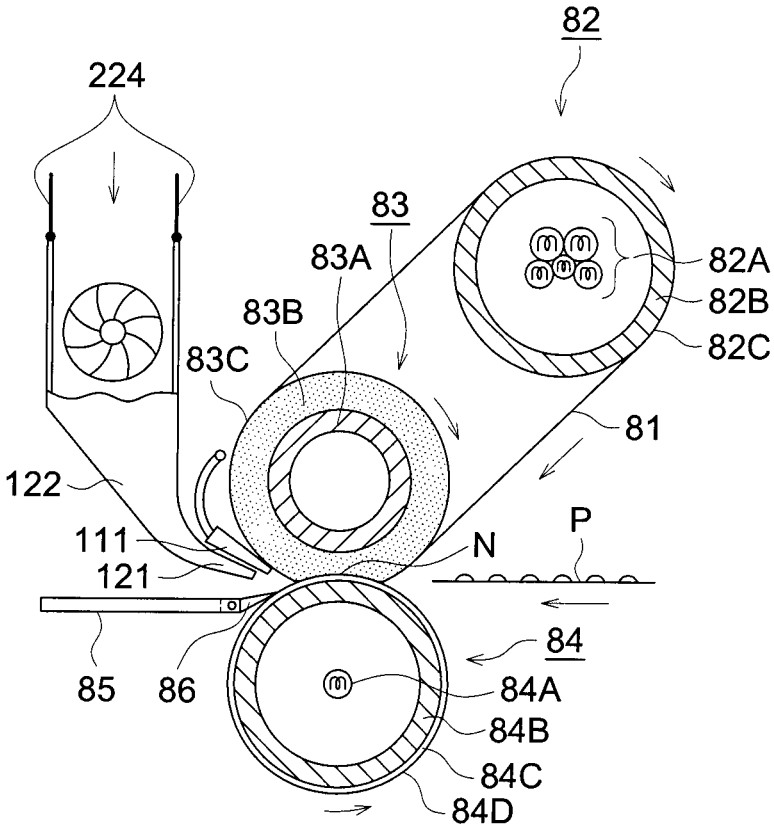
FIG. 11 is a cross sectional view of a belt fixing device wherein a second valve is arranged close to the suction port and is placed in the open position.

As shown in FIG. 10 and FIG. 11, the second valve 224 can be mounted close to the suction port of the duct 122.

In addition, any one of the first air nozzle 111 and the leading edge of the second air nozzle 121 with respect to the nip portion N can be positioned closer to the nip portion N. Alternatively, both the first air nozzle 111 and the leading edge of the second air nozzle 121 can be mounted at the same position.

The foregoing description is based on the assumption that the quantities of the first air nozzle 111 and the second air nozzle 121 are five. However, the quantities thereof are not restricted thereto.

The fixing device using the first air nozzle 111 and second air nozzle 121 is not restricted to the aforementioned belt fixing device. Any type of fixing device can be used as such. For example, it can be a fixing device of the heat roller fixing system wherein the recording medium carrying a toner image transferred thereon is heated and pressed, while being sandwiched and conveyed by the nip portion formed by the fixing roller (fixing member) incorporating such a heating unit as a halogen heater and the pressure roller for applying pressure to the fixing miler.

Incidentally, louvers are provided on the front and rear of the image forming apparatus as shown in FIG. 1. The outside air sucked by opening of the louvers passes through the air introducing duct located on the upper portion of the fixing device and is led to the fan at the outlet of the fixing device. This air introducing duct is kept at a low temperature by the outside air and is used to control the temperature rise in the toner reservoir section caused by thermal diffusion from the fixing device.

The air discharged from the first air nozzle 111 and the second air nozzle 121 is led to the opening provided at the end of the image forming apparatus on the outside side of the fixing device by the duct using a part of the recording/conveying guide as a wall. An exhaust fan on this opening, if provided, will ensure efficient exhaustion and will minimize the thermal contamination inside the apparatus caused by the temperature rise due to blowing of heated air to the fixing device. When a post-processing apparatus (finishing apparatus) is connected to the image reading apparatus, the top or rear surface of the image forming apparatus is provided with an opening to remove air.

What is claimed is:

1. A fixing device comprising:

fixing member that is heated;

a pressure member to form a nip portion between the pressure member and the fixing member, wherein the fixing member and the pressure member fix a toner image on a recording medium;

a first blowing unit located close to an outlet of the nip portion which separates the recording medium from the fixing member by blowing air to the recording medium; and a second blowing unit located close to an outlet of the nip portion which separates the recording medium from the fixing member by blowing air to the recording medium, wherein a velocity of the air discharged from the first blowing unit is higher than that of the air discharged from the second blowing unit, whereas a volume of the air discharged from the first blowing unit is smaller than that of the air discharged from the second blowing unit; and the first blowing unit starts discharging air before a leading edge of the recording medium reaches the outlet of the nip portion, whereas the second blowing unit starts discharging air after the leading edge of the recording medium has passed through the outlet of the nip portion.

2. The fixing device described in claim 1, wherein before the leading edge of the recording medium reaches the outlet of the nip portion, the volume of air discharged from the first blowing unit is greater than a volume of air necessary to separate the recording medium from the fixing member.

3. The fixing device described in claim 1, wherein the volume of air discharged from the first blowing unit is capable of separating the recording medium from the fixing member when the leading edge of the recording medium has reached the outlet of the nip portion.

4. The fixing device described in claim 1, wherein air is discharged from the first blowing unit even after air discharge from the second blowing unit has started.

5. The fixing device described in claim 1, wherein discharge of air from the first blowing unit is suspended after the volume of air discharged from the second blowing unit has risen to a level capable of separating the recording medium from the fixing member.

6. The fixing device described in claim 1, wherein the first blowing unit has a first valve for controlling air discharge by open-close operations, and the second blowing unit has a second valve for controlling air discharge by open-close operations.

7. The fixing device described in claim 6, wherein the second valve starts opening before the first valve starts closing.

8. The fixing device described in claim 7, wherein, after the first valve has started closing, the sum of the volume of air discharged from the first blowing unit and the volume of air discharged from the second blowing unit is equal to or greater than the volume of air capable of separating the recording medium from the fixing member.

9. The fixing device described in claim 6, wherein the second valve starts closing after the trailing edge of the recording medium has passed through the outlet of the nip portion.

10. The fixing device described in claim 6, wherein the first valve of the first blowing unit is an electromagnetic valve, and the second valve of the second blowing unit is an open/close valve that opens or closes inside a duct.

11. The fixing device described in claim 1, wherein, before the trailing edge of the recording medium is conveyed to the outlet of the nip portion, the volume of air discharged from the second blowing unit is maintained at the level that allows the recording medium to be separated from the fixing member.

12. The fixing device described in claim 1, wherein the first blowing unit discharges the high-pressure air generated by a compressor, and the second blowing unit discharges the air sent by a fan.

13. An image forming apparatus comprising the fixing device of claim 1.

14. A fixing method for fixing a toner image on a recording medium at a nip portion formed between a fixing member that is heated and a pressure member comprising steps of:

having the fixing member and the pressure member in pressure contact with each other;

inserting a recording medium which carries a toner image to the nip portion;

fixing the toner image onto the recording medium being sandwiched and conveyed by the nip portion;

separating the recording medium from the fixing member by blowing air to the recording medium by a first blowing unit located close to an outlet of the nip portion; and separating the recording medium from the fixing member by blowing air to the recording medium by a second blowing unit located close to an outlet of the nip portion, wherein a velocity of the air discharged from the first blowing unit is higher than that of the air discharged from the second blowing unit, whereas a volume of air discharged from the first blowing unit is smaller than that of the air discharged from the second blowing unit; and the first blowing unit starts discharging air before a leading edge of the recording medium reaches the outlet of the nip portion, whereas the second blowing unit starts discharging air after the leading edge of the recording medium has passed through the outlet of the nip portion.

15. The fixing method described in claim 14, wherein before the leading edge of the recording medium reaches the outlet of the nip portion, the volume of air discharged from the first blowing unit is greater than a volume of air necessary to separate the recording medium from the fixing member.

16. The fixing method described in claim 14, wherein discharge of air from the first blowing unit is suspended after the volume of air discharged from the second blowing unit has risen to a level capable of separating the recording medium from the fixing member.

17. The fixing method described in claim 14 wherein the first blowing unit has a first valve for controlling air discharge by open-close operations, and the second blowing unit has a second valve for controlling air discharge by open-close operations.

18. The fixing method described in claim 17, wherein the second valve starts opening before the first valve starts closing.

19. The fixing method described in claim 18, wherein, after the first valve has started closing, the sum of the volume of air discharged from the first blowing unit and the volume of air discharged from the second blowing unit is equal to or greater than the volume of air capable of separating the recording medium from the fixing member.

20. The fixing method described in claim 17, wherein the second valve starts closing after the trailing edge of the recording medium has passed through the outlet of the nip portion.

21. The fixing method described in claim 14, wherein, before the trailing edge of the recording medium is conveyed to the outlet of the nip portion, the volume of air discharged from the second blowing unit is maintained at the level that allows the recording medium to be separated from the fixing member.

* * * * *